US006132343A

United States Patent [19]

Eze

[11] Patent Number: 6,132,343

[45] Date of Patent: Oct. 17, 2000

[54] PHYSICAL CONDITIONING APPARATUS

[76] Inventor: Obi Walter Eze, 1019 Pensacola St., Foster City, Calif. 94404

[21] Appl. No.: 09/016,260

[22] Filed: Jan. 30, 1998

[51] Int. Cl.[7] ..... A63B 21/00

[52] U.S. Cl. ..... 482/97

[58] Field of Search ..... 482/95–97, 900–902, 482/1–9, 92, 110

[56] References Cited

U.S. PATENT DOCUMENTS

| | | | |
|---|---|---|---|
| 684,688 | 10/1901 | Herz | 482/97 |
| 956,264 | 4/1910 | Bailey | 482/97 |
| 1,703,104 | 2/1929 | Hassler | 482/97 |
| 1,928,515 | 9/1933 | Tiegel | 482/97 |
| 4,423,864 | 1/1984 | Wilk | 482/54 |
| 4,930,770 | 6/1990 | Baker | 482/95 |
| 5,308,303 | 5/1994 | Rawls et al. | 482/97 |

*Primary Examiner*—Glenn E. Richmon

*Attorney, Agent, or Firm*—Henry G. Kohlmann

[57] ABSTRACT

Apparatus for strength and aerobic conditioning is disclosed, and comprises a frame with support from which a support arm projects. A rotatable hub is mounted on the support arm, and a suspension rod with a resistance mass at one end depends from the hub. The suspension rod is slidable through the hub and may be set in different angular positions relative to the hub. A crank with a handle and adjustable-length offset arm are engaged with the end of the support arm opposite the hub. A stand or platform for secure footing may be used across the base of the frame or, alternatively, a treadmill/workout bench, when unfolded folded, may be used under foot. The treadmill/workout bench has a rectangular frame with side rails; cross braces; forward, rearward and interior rollers; and, one or more endless, circulating belts. An electromechanical fitness planning and evaluating embodiment includes motion and position sensors associated with moving parts of the apparatus, a video monitor mounted on a standard upstanding from the frame, and a control box with a microprocessor to which both the sensors and the video monitor are connected.

10 Claims, 10 Drawing Sheets

PHYSICAL CONDITIONING APPARATUS

BACKGROUND OF THE INVENTION

1. Field Of The Invention

The present invention relates generally to apparatus for complete physical conditioning, and more specifically to apparatus for both strength training, by either upright or prone repetitive motion of a body part against a mechanism providing resistance against that motion, as well as apparatus for aerobic conditioning by simulated walking, running or skiing.

2. Description Of The Related Art

Persons engaging in strength training traditionally have two primary categories of apparatus available to use in that pursuit: free weights and weight-simulating, resistance-producing mechanisms. Free weights have some benefits, but individual muscles and muscle groups are much more easily isolated with weight-simulating, resistance-producing mechanisms.

One popular type of weight-simulating, resistance-producing mechanism includes those employing a free-standing frame. This type is exemplified by the product lines of several well known manufacturers, including Universal® and Nautilus®. The resistance-producing mechanisms employed in free-standing strength training apparatus are typically of several varieties: cable and pulley-operated counterweights; lever-activated counterweights; hydraulic systems; and, pneumatic systems. Lever-activated, counterweighted systems are, by far, the simplest and most reliable. However, lever-activated, counterweighted systems are commonly inconveniently large, requiring considerable floor space, and they often include an unwieldy collection of weights, frame members and other equipment which make transportation and storage difficult.

Limitations in the design and structure of common free-standing, frame-based resistance-producing workout mechanisms often make them difficult to accommodate workouts which include sets performed in a standing position, such as biceps curls, and sets performed in a prone position, such as bench presses.

Free-standing, frame-based resistance-producing workout mechanisms also usually lack features which permit the type of aerobic activities that promote overall cardiovascular fitness. Simulating walking, running or skiing for cardiovascular exercise in an indoor environment usually requires a large, complex, expensive treadmill and/or skiing simulator, and these are separate and apart from any frame-based, resistance-producing workout equipment used for strength training. Thus, those requiring indoor workout equipment for both strength and aerobic conditioning commonly must incur a considerable expense for at least two pieces of equipment. And, they must endure great inconvenience in providing space for, in storing, and in transporting such equipment.

Thus, it appears that a need exists for simple, compact, reliable and inexpensive apparatus for complete physical conditioning, including capabilities for both strength training and aerobic exercise.

SUMMARY OF THE INVENTION

The physical conditioning apparatus of the present invention is adapted to overcome the above-noted shortcomings and to fulfill the stated needs. The strength training portion of its apparatus first comprises a frame including a base portion and an upward-projecting support standard. A hub is mounted on the support standard, the hub being rotatable about a horizontal axis of rotation. A resistance mass is suspended upon means for suspending that mass radially away from the horizontal axis of the hub. The resistance mass is rigidly engaged with the hub via the suspension means such that when the hub rotates, the mass moves in an arc in a plane perpendicular to the hub's axis of rotation. A crank is engaged with the hub, the crank including a primary shaft parallel with the hub's axis of rotation. An offset arm projects from the primary shaft, and attached thereto are means for actuating the crank.

The treadmill/workout bench portion of the apparatus permits both aerobic conditioning and additional strength training functions. It comprises a generally planar, rectangular, rigid frame having first and second opposed end edges and a pair of opposed side edges. An endless, flexible belt having opposed, parallel side edges is wrapped around the frame such that one half of the belt's length passes above the frame and one half of the belt's length passes below. The side edges of the belt are parallel with the side edges of the frame, such that the belt wraps around the first and second end edges of the frame. Means are provided at the first and second end edges of the frame for reducing friction of the belt against the frame as the belt passes in a continuous circulating motion from end to end around the frame, thus permitting the belt to function as a treadmill. In an alternative embodiment, twin, parallel, side-by-side belts are employed, separate friction-reducing means being provided for each. Friction-increasing means may also be employed for single or double-belt embodiments. The aerobic conditioning apparatus further includes a generally rectangular first panel having a pair of opposed end edges and a pair of opposed side edges, one of these end edges being hingedly engaged with the first end edge of the rigid treadmill frame such that the rectangular first panel may be selectively placed in at least two positions. In the panel's first position, it is in an end-to-end relationship with the rigid frame wherein the rigid frame and the first panel reside in the same plane. In the first panel's second selective position, it is folded over to lie atop an upper surface of the endless belt atop the rigid frame such that the first panel, the endless belt and the rigid frame reside in stacked, parallel planes.

A second panel may also be employed, first and second panels then each being hingedly engaged with respective first and second end edges of the rigid frame. The first and second panels are each individually positionable at different angles with respect to the plane of the rigid frame. Means such as adjustable legs are provided to support the apparatus above the floor, which permits use of the rigid frame and out-folded panels to be used as a workout bench for bench presses, and the like, either alone or in combination with the strength training portion of the physical training apparatus.

In yet a further embodiment of the invention, the capability of planning and evaluating a user's fitness is made possible by the addition of: motion and position sensors embedded in the apparatus' various mechanical elements; data storage and retrieval apparatus in communication with the motion and position sensors; and, a video monitor in communication with the data storage and retrieval apparatus.

It is an object of the present invention to provide physical conditioning apparatus permitting a user to engage in both strength training and aerobic training.

It is a further object of the present invention to provide free-standing, lever-activated, counterweighted physical conditioning apparatus including weight-simulating, resistance-producing abilities, wherein the apparatus is extremely simple and compact, employing a minimal number of frame and weight members making it easy to store and transport, and wherein the apparatus further requires a minimal amount of floor space during use.

Yet another object of this invention is to provide free-standing, frame-based resistance-producing workout apparatus able to accommodate both standing and sitting strength-training workouts.

Yet a further object of the present invention is to provide physical conditioning apparatus for both strength and aerobic conditioning, wherein the apparatus is compact and inexpensive, yet includes components for simulating walking, running and/or skiing.

Yet another object of the present invention is to provide physical conditioning apparatus able provide a workout routine to the user, to record the user's performance, and/or to compare the user's performance with data sets from other performances.

Still further objects of the inventive physical conditioning apparatus disclosed herein will be apparent from the drawings and following detailed description thereof.

DESCRIPTION OF THE PREFERRED EMBODIMENT

Figure 1:
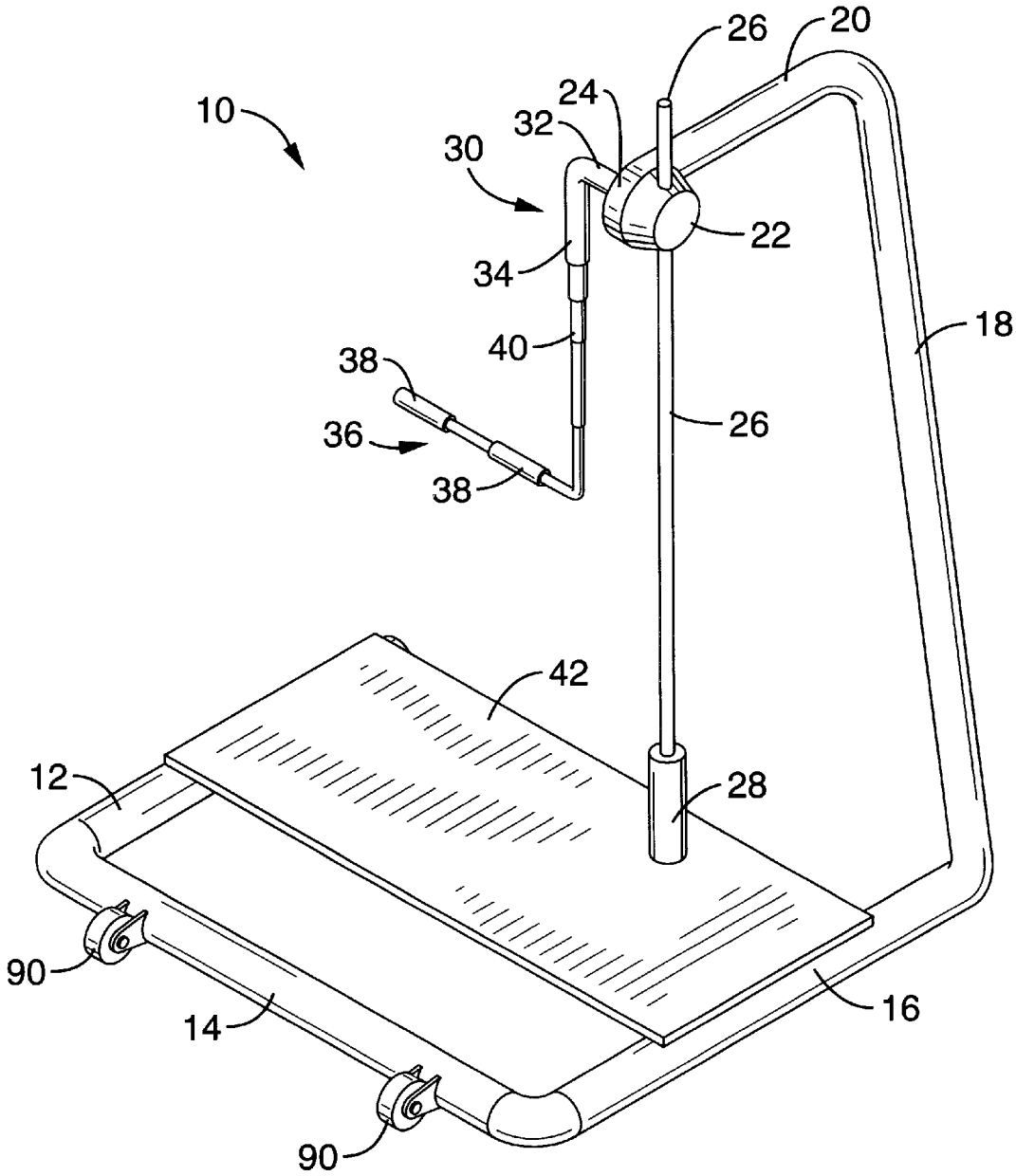
FIG. 1 is a perspective view of the strength training portion of the physical conditioning apparatus of the invention, from the upper left side thereof.
Figure 2:
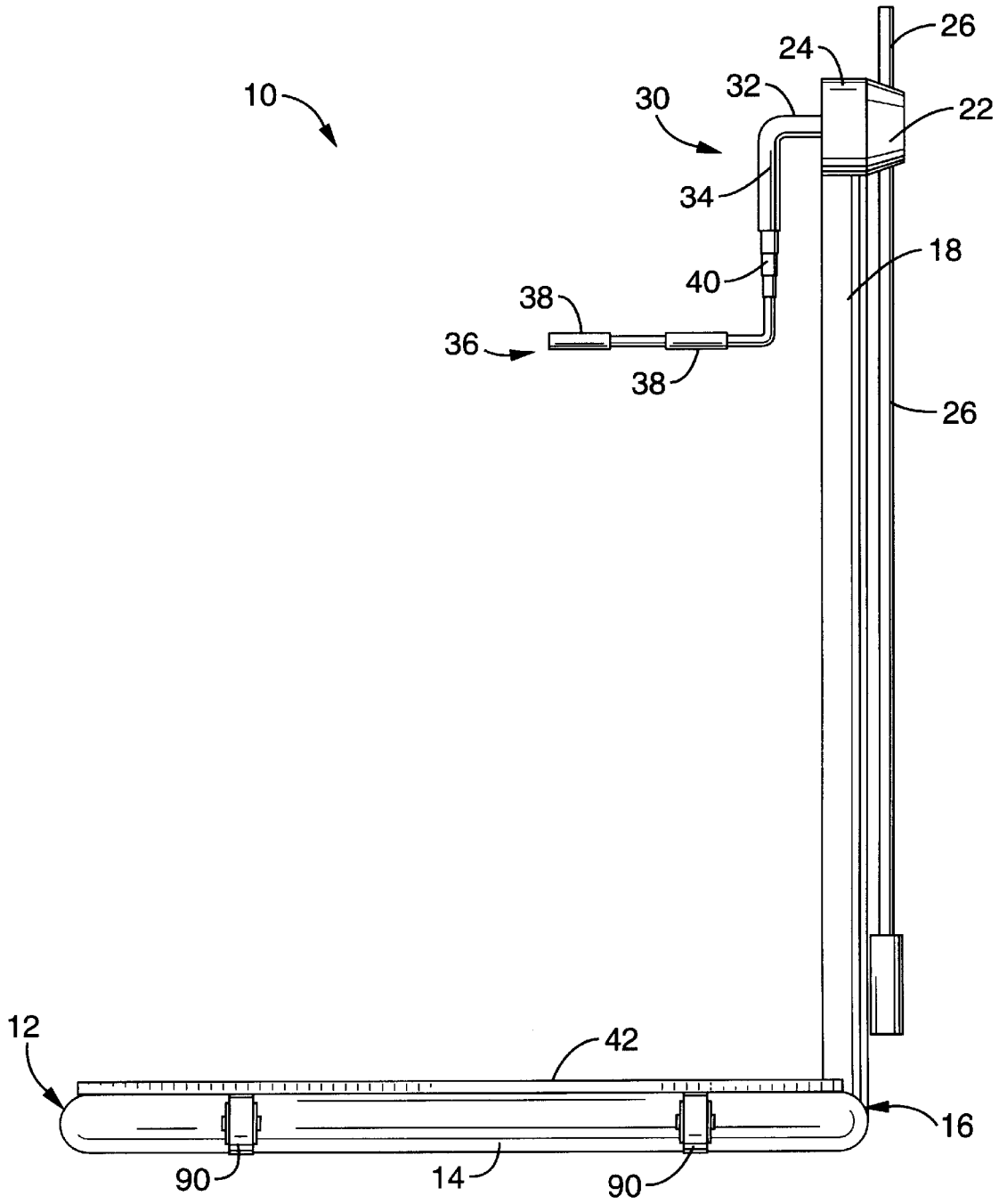
FIG. 2 is a front elevation of the strength training portion of the physical conditioning apparatus of the invention.

Referring now specifically to the drawings, FIGS. 1 and 2 show the general structure of the strength training portion of the physical conditioning apparatus of the invention, the strength training portion being generally identified herein with the reference numeral 10. The frame of strength training portion 10 is comprised of a lowermost U-shaped portion which is, in turn, comprised of right side base bar 12, front cross base bar 14 and left side base bar 16. Bars 12, 14 and 16 all reside in the same plane. The frame of strength training portion 10 is open rearwardly. For clarity, discussion herein involving directional orientation, including left, right, forward, front, rearward, back and the like, will be consistent with the corresponding portions of the U-shaped portion of the base frame of strength training portion 10 set forth above.

Support standard 18 projects upward from the rearward end of left side bar 16. Support standard 18's upper end tilts toward the front side of apparatus 10, but support standard 18 is preferably in the same plane as left side bar 16. Support arm 20 projects generally horizontally toward the front of apparatus 10 from the upper end of support standard 18.

The frame of strength training portion 10 may be of any desired dimensions, although it is expected to be convenient to construct portion 10 such that support arm 20 is approximately between chest and shoulder height for an average-sized user.

A hub 22 is mounted on the left side of the forward end of support arm 20. Hub 22 is frusto-conical in shape, its wider, base portion being to the right and its narrower, apical portion being to the left side of apparatus 10. Hub 22 is generally rotationally symmetrical around its central, horizontally-oriented axis. Hub 22 is mounted on support arm 20 so as to rotate about a horizontal axis. Hub 22 is preferably engaged with an annular lug 24 at the end of support arm 20.

Suspension rod 26 passes through a channel (unnumbered) in the left side of hub 22, perpendicular to hub 22's axis of rotation. Suspension rod 26 is freely slidable to and fro through that channel in hub 22. A set screw (not shown) in hub 22, or any known equivalent mechanism, is used to fix suspension rod 26 at any desired position with respect to hub 22.

One end of suspension rod 26 has a resistance mass 28 mounted thereupon. Resistance mass 28 may conveniently be a dense metal cylinder weighing ten pounds, or so. Heavier resistance masses may be used for more strenuous workouts. The action of gravity upon resistance mass 28 causes suspension rod 26 to hang normally in a vertical orientation.

Crank 30 passes through lug 24 at the end of support arm 20 and is engaged with the right side of hub 22. Crank 30 includes primary shaft 32 which is horizontal and is the portion of crank 30 which directly engages hub 22 through lug 24. The left end of primary shaft 32 of crank 30 is preferably splined or otherwise shaped for engagement with the right side of hub 22. Offset arm 34 projects at a right angle from the right end of primary shaft 32. Thus, as primary shaft 32 rotates on its horizontal axis, offset arm 34's motion describes an arc in a vertical plane. Handle 36, for actuating crank 30, projects rightward, horizontally, from the outer end of offset arm 34. Handle 36 preferably includes one or more padded grips 38 to provide a user a non-slip grasp on handle 36; and, other crank offsets may be added for comfort.

For the fullest versatility of the strength training portion 10 of the apparatus, it is important that primary shaft 32 of crank 30 be able to be withdrawn from hub 22 and reinserted after some rotation on primary shaft 32's horizontal axis, or that some other means be provided to change the rotational position of crank 30 with respect to hub 22. This permits the user to conduct a workout wherein the starting or "home" position of handle 36 is in any desired location while suspension rod 26 and resistance mass 28 hang vertically at rest. That is, the home position of handle 36 may be set above, below, forward of or rearward of a horizontal line through primary shaft 32 of crank 30 to accommodate the user for different types of workouts.

Further versatility of the strength training portion 10 of the apparatus is achieved by providing several telescoping subunits 40 within the length of offset arm 34. Telescoping subunits 40 preferably include a mechanism for selectively locking each subunit against movement in relation to its adjacent subunit(s). Many mechanisms are known for locking the positions of telescopic subunits, and many alternative non-telescopic mechanisms for providing secure adjustability in offset arm 34 are known, as well. Any of these may be used without departing from the spirit of the invention.

As hub 22 rotates about its horizontal axis in response to movement of crank 30, suspension rod 26 swings through an arc in a vertical plane. Moving handle 36 from its home position causes resistance mass 28 to be displaced from its normal lowermost position. As resistance mass 28 is so moved, the type of resistance required for strength training is felt by the user in crank handle 36.

In use in carrying out a standing workout, the user will normally stand within the U-shaped frame of strength training portion 10 facing rearward. If desired, stand platform 42 or the like may be placed across right and left side base bars 12 and 16 for good footing and stability.

The magnitude of the resistance the user encounters in using the apparatus for a particular workout may be adjusted in several ways. As offset arm 34 is telescopically lengthened, the arc traveled by handle 38 has a larger radius; while as offset arm 34 is shortened, the radius of handle 38's arc is smaller. Having handle 36 closer to primary shaft 32 also provides the user with a shorter lever with which to raise resistance mass 28, thus requiring more muscular effort. Lengthening offset arm 34 provides a longer lever, and less muscular effort. The length and shape of the path traced by handle 36, and thus the stroke path of the user's appendages engaged therewith, are also affected by the length to which offset arm 34 is set.

Resistance and handle path may be further manipulated by fixing the position of suspension rod 26 in hub 22 so that resistance mass 36 is closer to or farther away from hub 22. More muscular effort is required when resistance mass 28 is farther from hub 22, and less effort is required when resistance mass 28 is closer. Thus, if the user desires to work out using a long handle path with a great amount of resistance, offset arm 34 is elongated and resistance mass 22 is moved as far as possible from hub 22. To increase resistance, offset arm 34 may be shortened, thus also shortening the path. Bringing resistance mass 28 closer to hub 22 keeps the same shortened handle path and arm stroke, but reduces the muscular effort needed.

As desired, resistance masses of different weights may be fitted to suspension rod 26 to change aspects of the workout.

Yet further versatility is achieved by beginning a workout with suspension rod 26 and resistance mass 28 in a position other than hanging vertically at rest. For example, for performing standing biceps curls, facing rearward, the user may desire to position crank 30 in hub 22 so that when the user's hands are grasping handle 36 with arms extended horizontally, suspension rod 26 and resistance mass 28 are roughly horizontal, extending rearwardly, well up and away from the home position. This way, the user experiences resistance at both the beginning and the end of a stroke.

Figure 3:
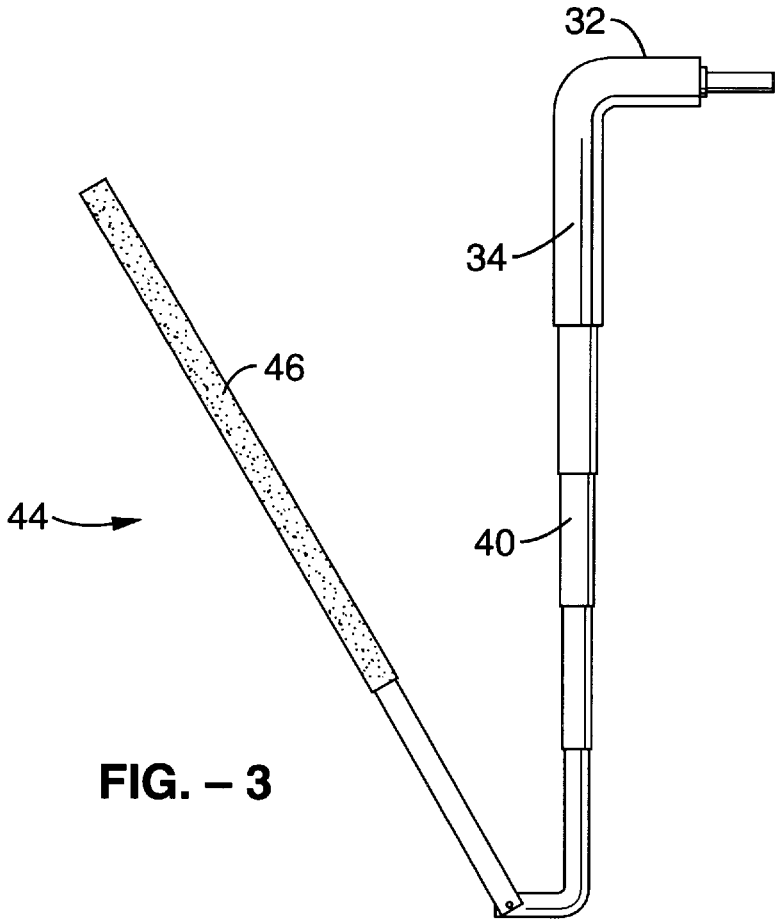
FIG. 3 is an enlarged, partial side elevation of an alternative universal handle for strength training for specific sports.

Strength training for specific sports may be accomplished by adding various other apparatus to strength training portion 10. For example, as shown in FIG. 3, a universal handle 44 may be engaged with or replace crank 30. Depending on how it is positioned, and perhaps the selection of one of several interchangeable grips, universal handle 44 may mimic the handle of a golf club 46, a tennis racket, or another sports device. Other body-engaging apparatus is also envisioned, such as special pads that may be fitted to handle 36 for leg lift exercises, or a chest pad for abdominal work.

Figure 4:
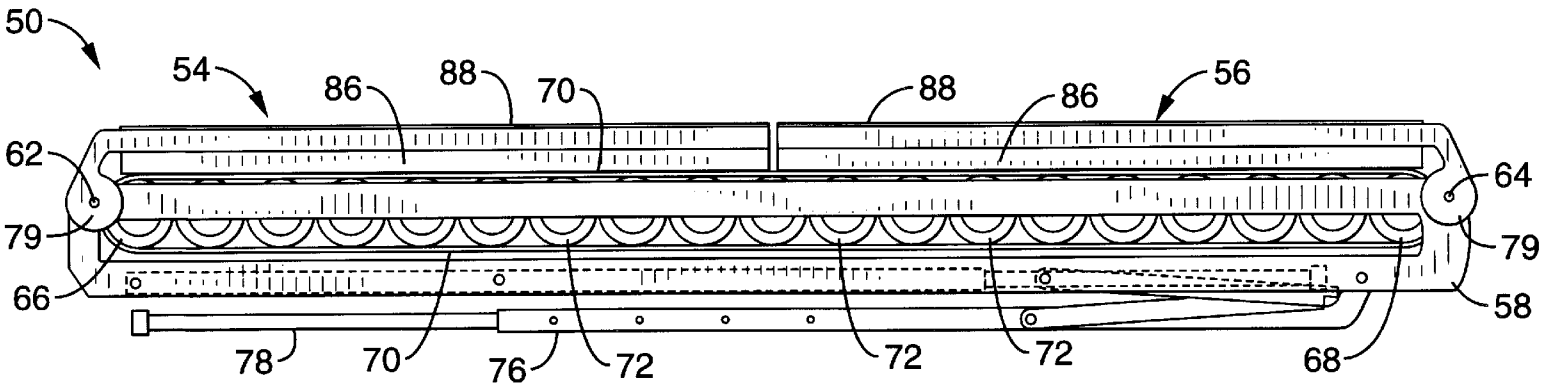
FIG. 4 is a side elevation of the treadmill/workout bench portion of the invention in its fully folded configuration being used as a standing platform.

FIGS. 4 through 10 show separate, but complementary, treadmill/workout bench portion of the apparatus, which is identified generally herein with reference numeral 50. Treadmill/workout bench 50 is a multi-purpose unit which, in its folded, stowed position works well as a stand platform as shown in FIG. 4.

Figure 5A:
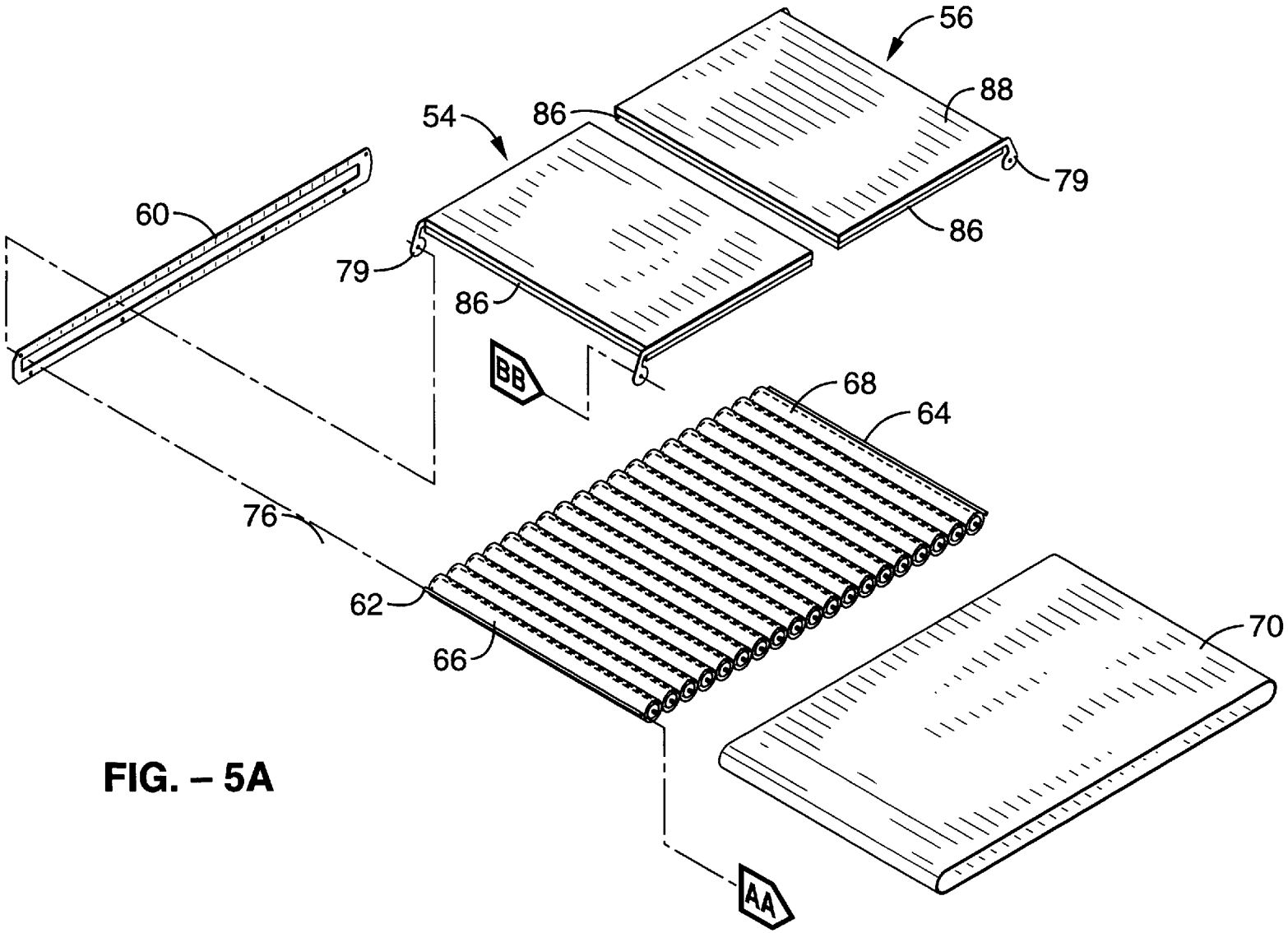
FIGS. 5A and 5B are exploded perspective views of the treadmill/workout bench portion of the invention.
Figure 5B:
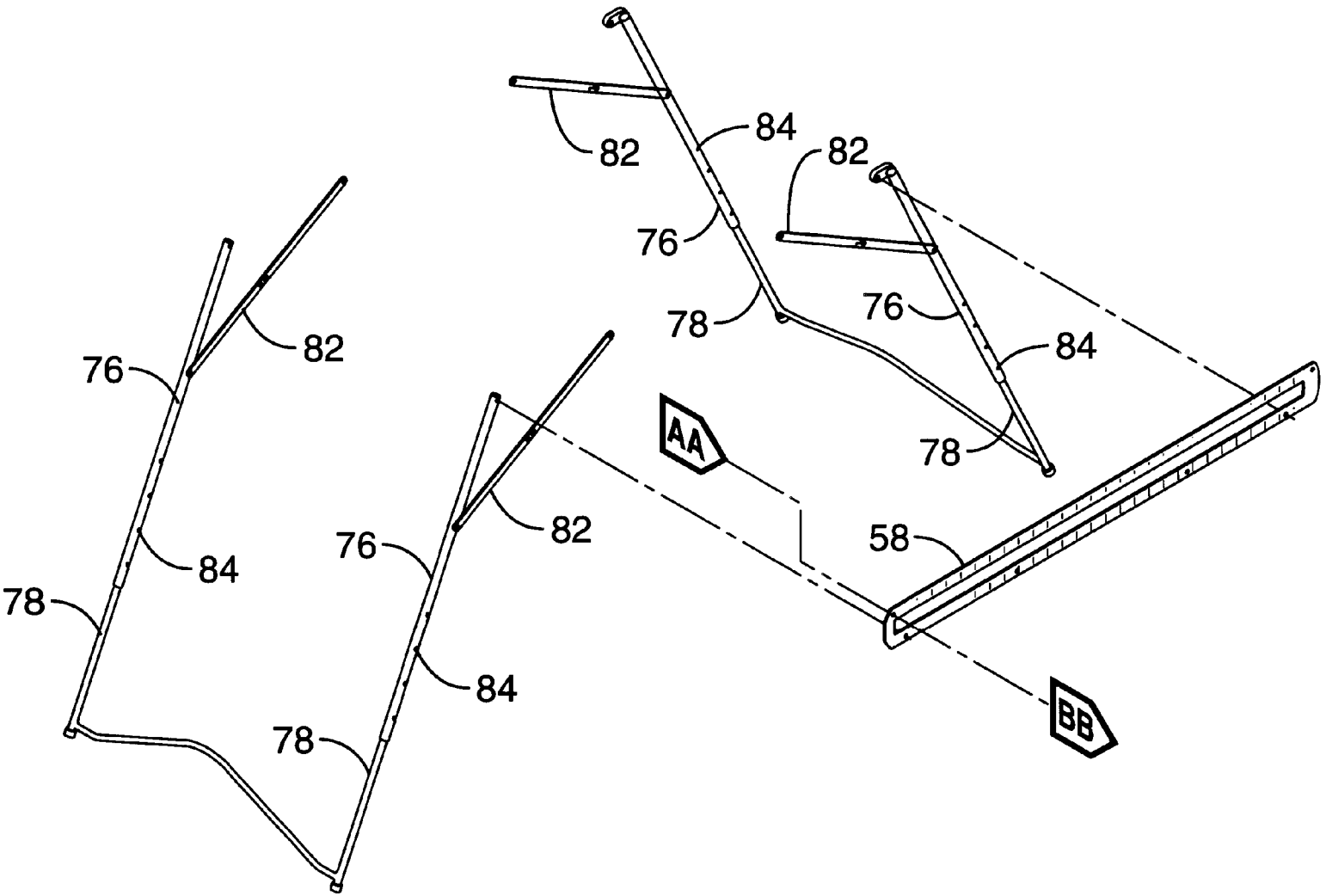

With reference to FIG. 5, treadmill/workout bench portion 50 includes a rigid, treadmill portion 52, and first and second hinged panel portions 54 and 56. Treadmill portion 52 includes a generally rectangular frame comprised of a pair of elongate, parallel side edge rails 58 and 60; transverse treadmill frame braces 62 and 64 at its forward and rearward end edges, respectively; and, at least one forward and one rearward roller 66 and 68, transversely disposed across the width of the forward and rearward ends of the frame. Endless belt 70 is generally rectangular, having parallel side edges which are, in turn, parallel with side rails 58 and 60. Endless belt 70 is wrapped around forward and rearward end rollers 66 and 68 such that one half of belt 70's length passes above the frame of treadmill portion 52, and one half of belt 70's length passes below. Additional interior rollers 72 are preferably disposed transversely throughout the entire length of treadmill portion 52 to support weight bearing down upon the upper surface of belt 70; to limit downward deflection of belt 70 caused by weight thereupon; and, to reduce frictional inhibition of the end-to-end circulating motion of belt 70 when its inner surface is in contact with interior rollers 72.

Side rails 58 and 60 are preferably of sufficient height to allow belt 70, when treadmill portion 52 is resting flat upon a horizontal surface, to circulate freely above and below rollers 66, 68 and 72. The leg mechanisms described below may further aid in providing that necessary clearance.

Rollers 66, 68 and 72 are of the same construction commonly used in recreational, non-powered treadmills for simulating walking and running. Each roller preferably includes a rigid axle therethrough and a thick, resilient covering. Belt 70 is also preferably of the same conventional, durable construction used in recreational, non-powered treadmills. Belt 70 must be thin and flexible enough, and rollers 66, 68 and 72 must include sufficiently efficient bearing mechanisms, to permit treadmill portion 52 to operate easily when a user is walking or running thereupon.

Treadmill portion 52 preferably includes a frictional and/or locking mechanical brake (not shown) able to lock or slow belt 70 and/or rollers 66, 68 and 72 against movement. Many different satisfactory braking, locking and resistance-increasing mechanisms are known and/or will be readily apparent to those skilled in the art.

Treadmill 52 permits aerobic workouts simulating walking and running. Such workouts may be carried out with treadmill 52 alone on a horizontal surface. Or, treadmill 52 may be used within the frame of strength training portion 10. If so used, it may also be preferable to withdraw primary shaft 32 of crank 30 from its engagement with hub 22 and the end of support arm 20 and to replace it with a straight, rigid, elongate, horizontal, grip bar (not shown) for use in keeping stability during a walking or running workout. Such a grip bar would be useful during workouts where increased resistance is applied to treadmill 52.

Figure 7:
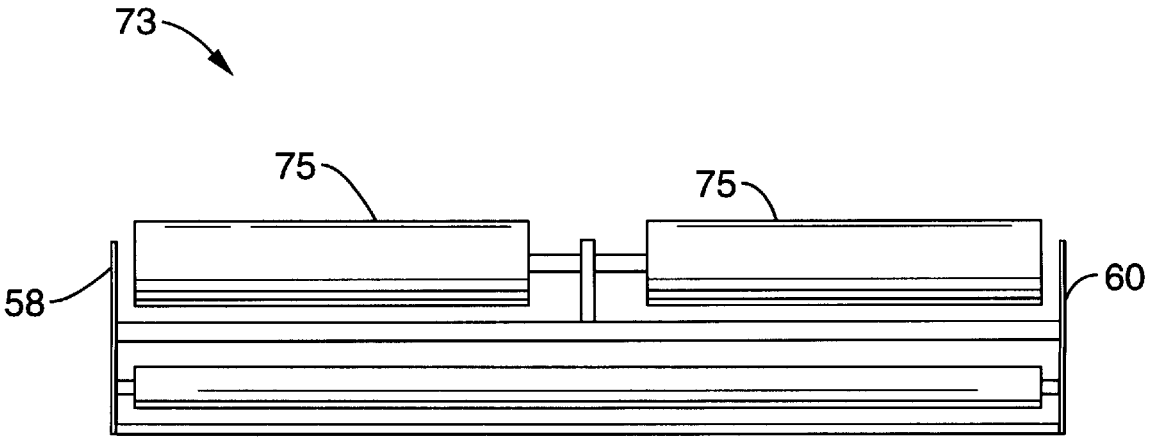
FIG. 7 is an end elevation view of an alternative embodiment of the treadmill/workout bench portion of the invention showing twin, parallel, side-by-side endless treadmill belts, with folding panels removed for clarity.

FIG. 7 shows an alternative treadmill/workout bench portion 73 of the invention, showing twin, parallel, side-by-side endless treadmill belts 75. As will be well understood by those generally skilled in the mechanical arts, twin belts 75 require separate forward, rearward and interior rollers, and frame elements to support these. A separate braking mechanism for each belt 75 is also envisioned. And, it is greatly preferred that each belt 75 have separately-operable resistance-increasing apparatus associated therewith. Such a twin-belt embodiment would permit a workout wherein the sliding, to-and-fro, opposed foot and leg motion of skiing is simulated. As will be understood by those skilled in the art, many varieties of simple bindings (not shown) able to fix the user's right foot to one belt and left foot to the other belt would be very beneficial in enhancing the skiing-simulation workout.

Beneath the treadmill portion 52 of treadmill/workout bench portion 50, two identical folding leg assemblies 74 are provided. Each leg assembly includes a pair of primary leg members 76; a single foot member 78 which ties the lower portions of primary leg members 76 together; a cross brace 80 which ties the upper portions of primary leg members 76 together; and, angled, folding side struts 82 on each side tying the upper portions of primary leg members 76 to side rails 58 and 60 of treadmill portion 52. Each foot member 78 of each leg assembly 74 is telescopically adjustable with respect to its primary leg members 76. A series of complementary adjustment pin apertures 84 are provided in primary leg members 76 and in the portions of foot member 78 which engage primary leg members 76. Pins, screws or the like may be used to set the overall lengths of leg assemblies 74 either temporarily or semipermanently. Although, for clarity, folded leg assemblies 74 are shown projecting somewhat beneath treadmill/workout bench 50 in FIGS. 4 and 6, side rails 58 and 68 may be fashioned to provide any desired amount of space for leg assemblies 74 beneath treadmill/workout bench 50.

First and second rigid, rectangular, hinged panels 54 and 56 project from the forward and rearward ends of treadmill portion 52. Each hinged panel 54 and 56 has side edges parallel to side rails 58 and 60 of treadmill portion 52; and, each hinged panel 54 and 56 has end edges parallel to the forward and rearward ends of treadmill portion 52 which are defined by forward and rearward transverse frame braces 62 and 64, and forward and rearward rollers 66 and 68. First hinged panel 54 has an end edge hingedly attached to the forward end of treadmill portion 52, adjacent forward frame brace 62 and roller 66. Second hinged panel 56 has an end edge hingedly attached to the forward end of treadmill portion 52, adjacent rearward frame brace 64 and roller 68.

Figure 6:
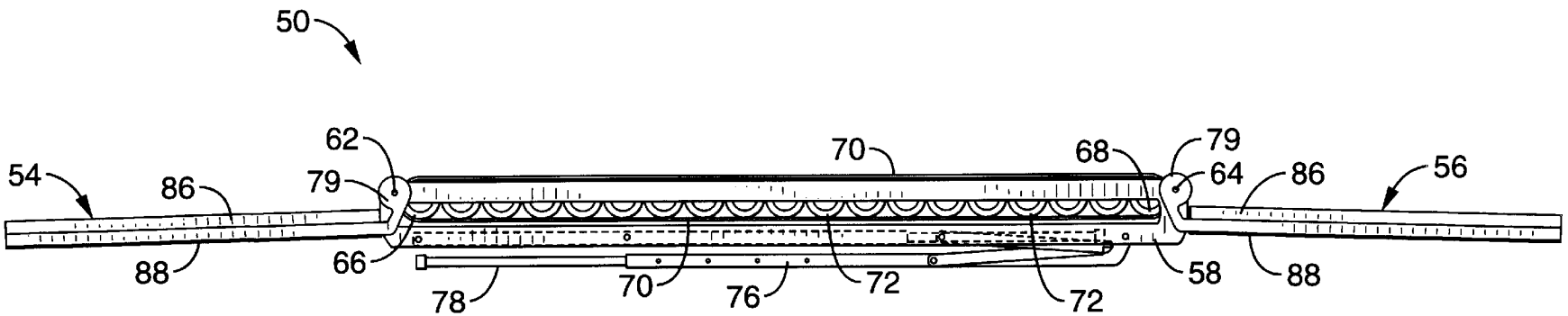
FIG. 6 is a side elevation of the treadmill/workout bench portion of the invention with its end panels folded out, thus permitting the apparatus to be used as a treadmill.

The hinges which bind panels 54 and 56 to treadmill portion 52 may be of any conventional design, as long as they prevent panels 54 and 56 from interfering with the motion of endless belt 70. For example, for convenience, pivoting brackets 79 may be engaged with the outer ends of forward and rearward frame braces 62 and 64. Further, each said hinge must be able to be locked to support its respective hinged panel in at least one extended position, that preferably being in an end-to-end relationship with the rigid frame of treadmill portion 52. An example of this is shown in FIG. 6 wherein treadmill portion 52's rigid frame and panels 54 and 56 reside in the same plane. Hinged panels 54 and 56 must also be able to be folded into a second, nonextended position, that being where they are retracted to lie atop an upper surface of endless belt 70. That is, in this second position, when a panel is so retracted, it lies atop treadmill portion 52 such that the panel 54 or 56, endless belt 70 and the rigid frame of treadmill portion 52 reside in stacked, parallel planes. This is best shown in FIG. 4.

Figure 8:
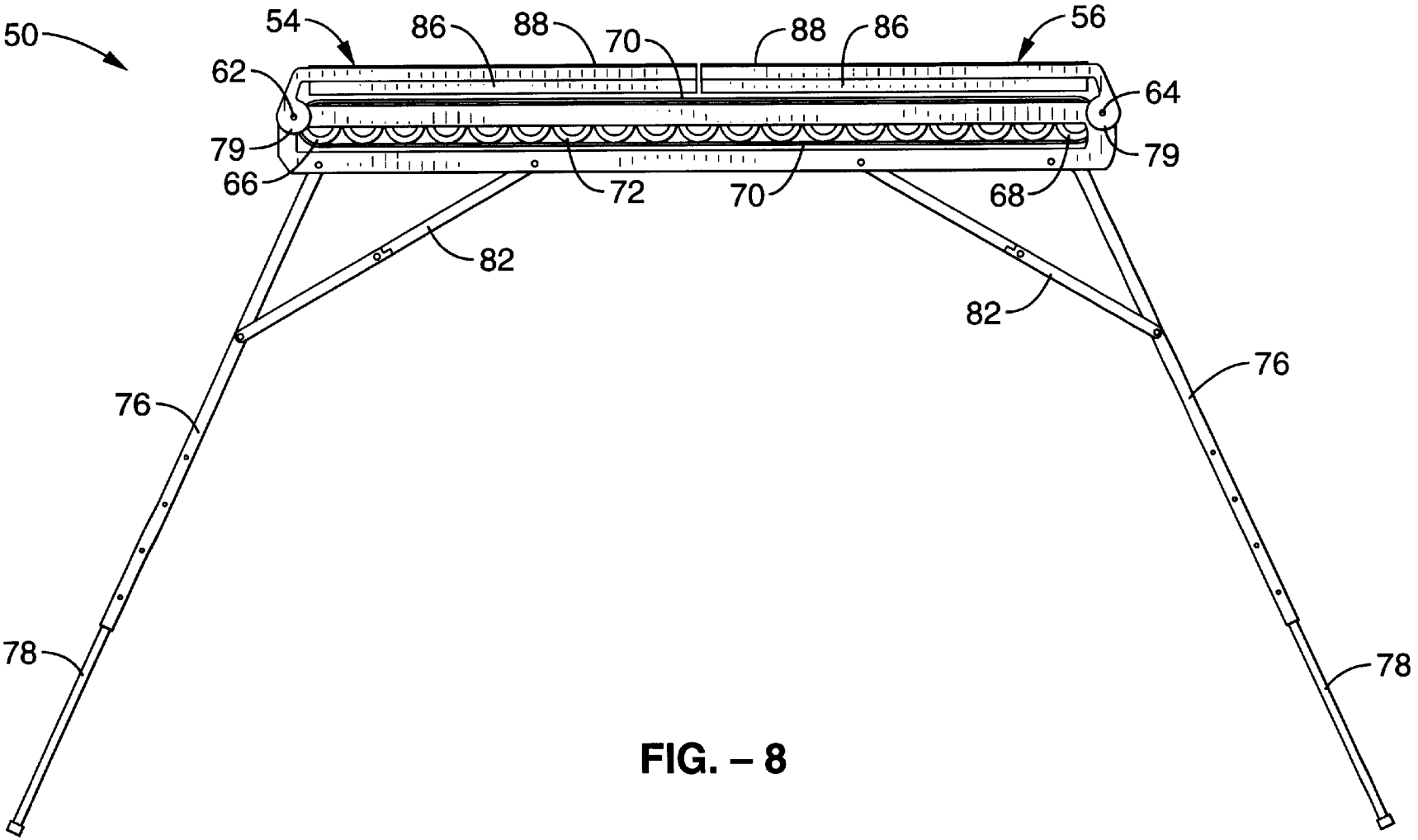
FIG. 8 is a side elevation of the treadmill/workout bench portion of the invention with its legs extended, permitting its use as a stool.
Figure 9:
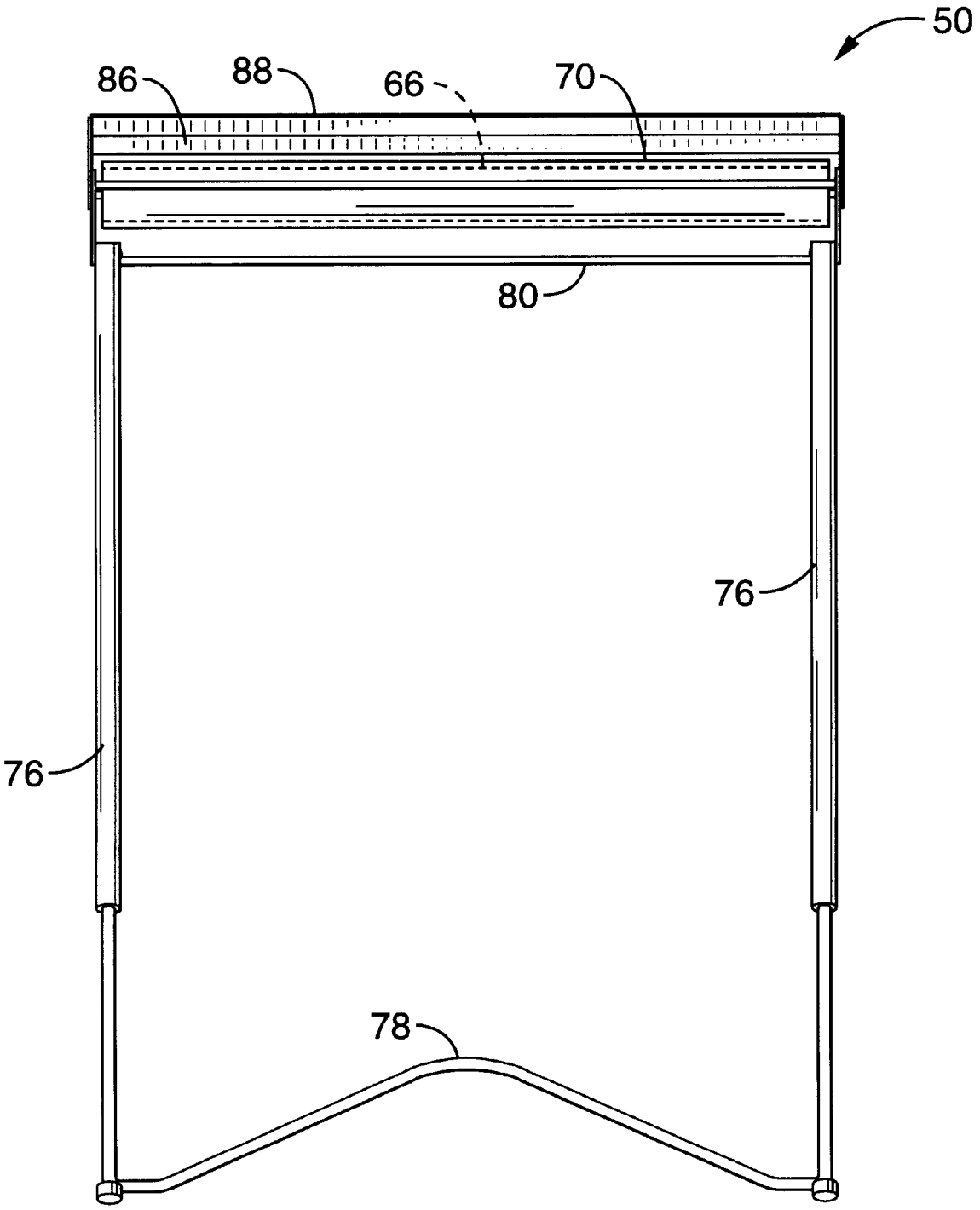
FIG. 9 is an end elevation of the treadmill/workout bench portion of the invention configured as in FIG. 8.

For yet further versatility, it is most preferred that hinged panels 54 and 56 be fitted with hinges that permit panels 54 and 56 to be set rigidly at any desired angle, either above or below the plane of treadmill portion 52. This permits the entire treadmill/workout bench 50 to be used as a stand platform as shown in FIG. 4; as a stool, as shown in FIG. 8; or, as a workout bench with adjustable upper and lower body supports, as shown in FIG. 9. Leg assemblies 74 may be folded beneath the frame of treadmill portion 52 when the apparatus is used as a stand platform, and these may be constructed to give additional clearance above the floor for unimpeded operation of endless belt 70.

The opposed faces of hinged panels 54 and 56 may include additional features to improve the overall utility of the apparatus. For example, it is preferred that a thick, soft comfortable pad 86 be affixed to those planar faces of panels 54 and 56 which are uppermost when panels 54 and 56 are folded outward from their stowed positions, as shown in FIG. 9. This permits comfortable use as a workout of the type which may be set in various different positions for different types of workouts. It is also preferred that the faces of panels 54 and 56 which are uppermost when panels 54 and 56 are in their fully retracted positions, as in FIG. 4, include a rubber mat 88 or coating to increase the friction or traction of these surfaces to improve the folded apparatus' usefulness as a stand platform.

Figure 10:
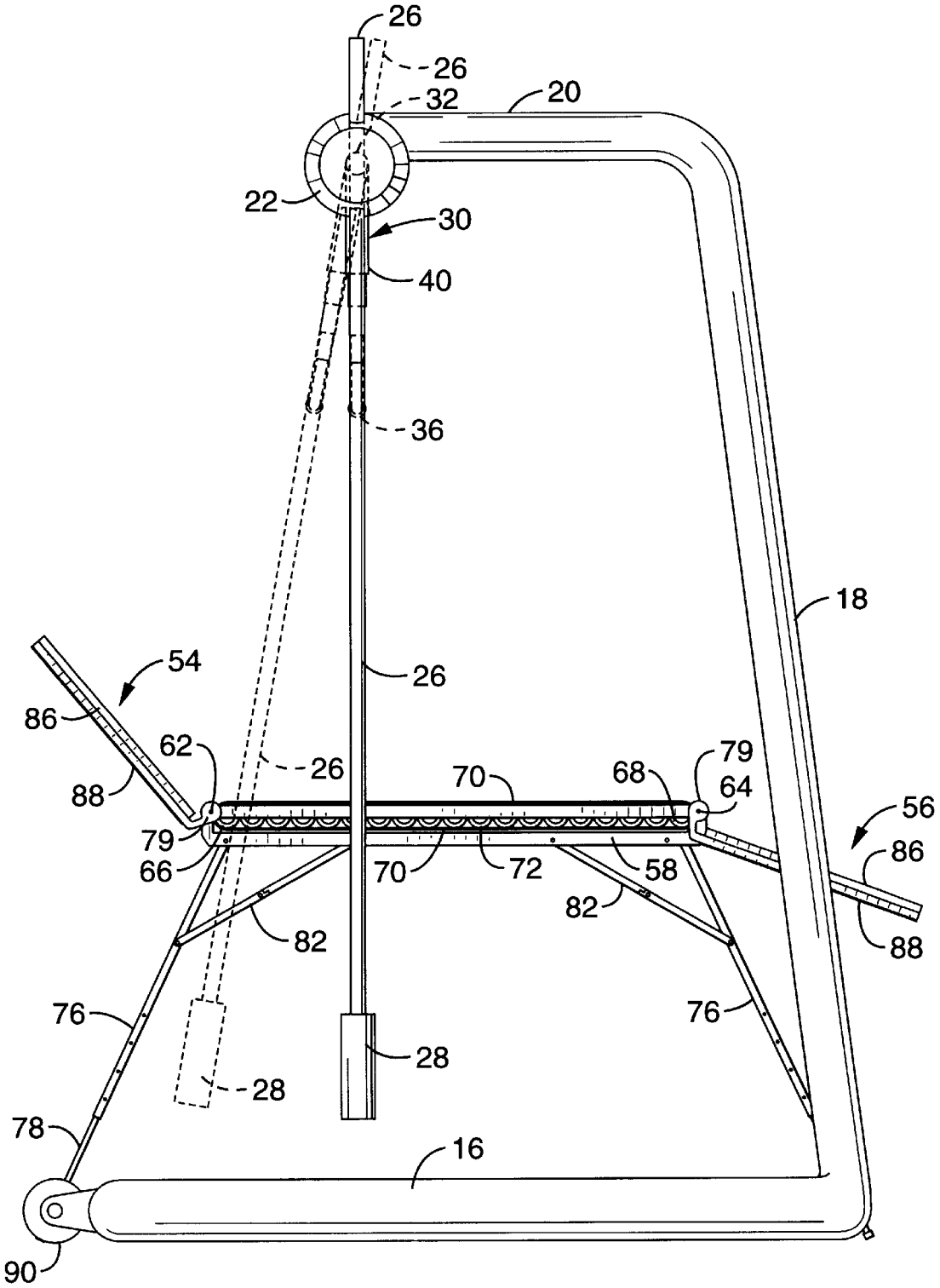
FIG. 10 is a side elevation of the treadmill/workout bench portion of the invention positioned for use as a workout bench in conjunction with the strength training portion of the invention, the treadmill/workout bench portion having its panels folded out and its legs extended.
Figure 11:
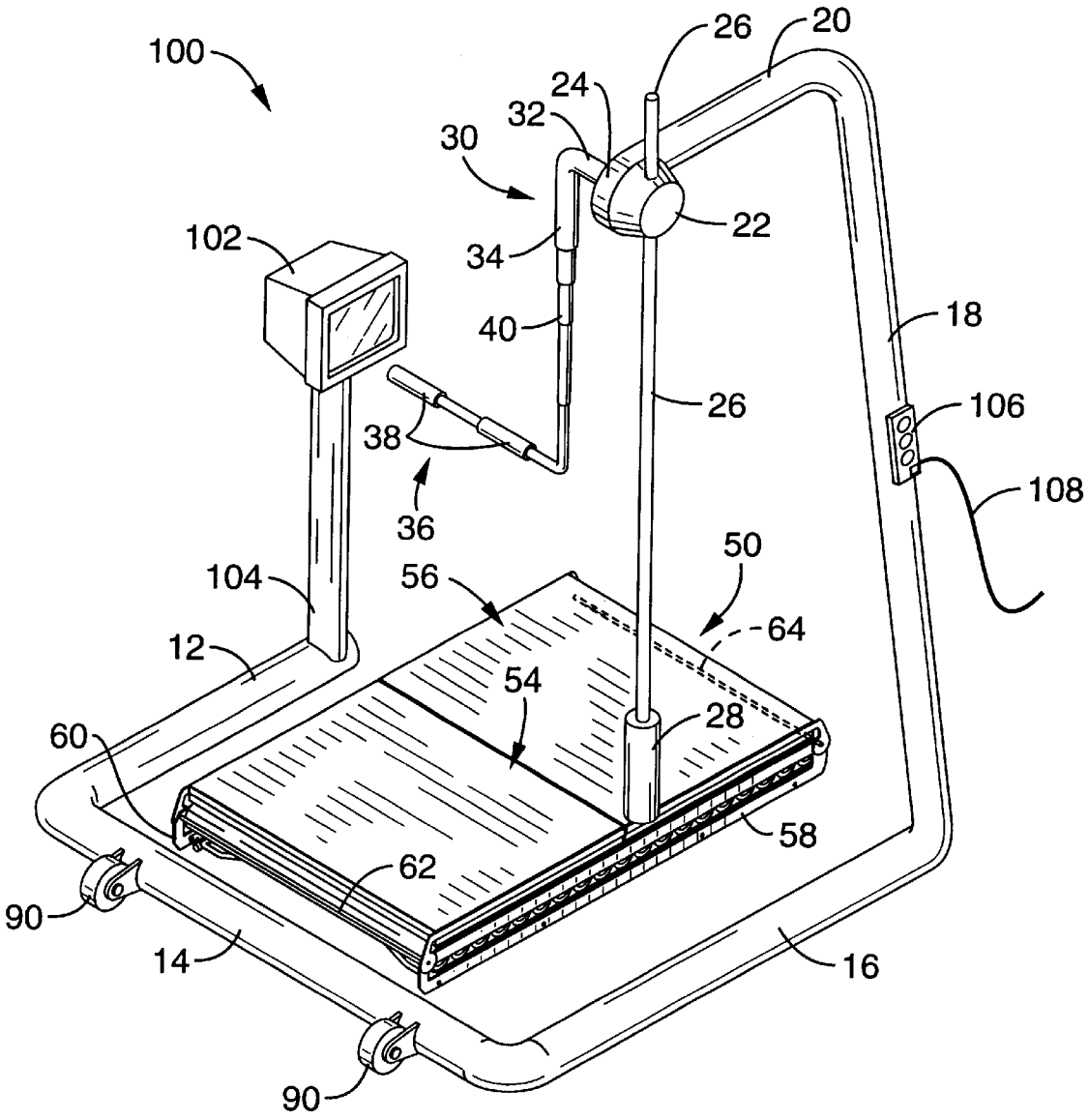
FIG. 11 is a perspective view of the fitness planning and evaluating version of the electromechanical physical conditioning apparatus.

As is apparent from the description and drawings, strength training portion 10 of the apparatus and treadmill/workout bench portion 50 may be used alone or, as shown in FIGS. 10 and 11, in combination with one another. Each portion is extremely portable, when compared with commonly-known items suited to similar functions. The treadmill/workout bench portion 50 could be made even more portable by adding a handle or a fitted case. Many handle and case configurations will be apparent to those skilled in the art. Further, it would be advantageous to add a pair of laterally-projecting wheels 90 to the front cross bar 14 of strength training portion 10's frame in order to render it more easily movable from one location to another. Alternatively, the frame of strength training portion may 10 be disassemblable.

Strength training portion 10 and treadmill/workout bench portion 50 may be used together in many ways, as will be apparent to those skilled in the art. And, as will be understood, crank 30 may be configured in many different shapes, with different offsets in different planes, etc. to facilitate many alternative kinds of workouts.

As a further improvement to the foregoing, an alternative, electromechanical, fitness planning and evaluating embodiment 100 of the inventive physical conditioning apparatus is shown in FIG. 11. Fitness planning and evaluating apparatus 100 includes a video monitor 102 disposed atop video monitor standard 104 which rises vertically from the rearward end of right side base bar 12. Video monitor 102 may be any convenient size, and montitor standard 104 may be adjustable in height. Video monitor 102 is preferably in communication with control unit 106 via cable internal to the apparatus. Control unit 106, as well as control apparatus within the housing of video montitor 102 (not shown) are preferably microprocessors, and may in turn be in communication with motion and/or position sensors in any moving part of apparatus 100, including hub 22, suspension rod 26, resistance mass 28, crank 30, and/or various elements of treadmills 50 and 73. Video monitor 102, control unit 106 and microprocessors within the housing of video monitor 102 are powered through electrical cable 108 and may record data sets gathered from the various sensors during a workout for later review, and those data sets may be used for later comparison with other data sets. Further, data sets may be loaded before a workout for comparison with a new data set as it is generated during a workout.

Fitness planning and evaluation embodiment 100 may provide the user with a workout plan; record the user's performance in a given workout; permit the user to compare a workout with his or her performance in prior workouts; or, permit the user comparison with performances of other athletes for entertainment or challenge.

The foregoing detailed disclosure of the inventive physical conditioning apparatus is considered as only illustrative of the preferred embodiment of, and not a limitation upon the scope of, the invention. Those skilled in the art will envision many other possible variations of the structure disclosed herein that nevertheless fall within the scope of the following claims.

And, alternative uses for this inventive apparatus may later be realized. Accordingly, the scope of the invention should be determined with reference to the appended claims, and not by the examples which have herein been given.

I claim:

1. A strength training apparatus, comprising:

a. a frame comprising a base portion and a support standard attached to said base;

b. a hub rotatable mounted on said support standard, said hub having an axis of rotation;

c. a resistance mass having a centroid, which is spaced apart from, said hub;

d. means for engaging said hub and for suspending said resistance mass radially away from the axis of rotation of said hub, such that when said hub rotates, the centroid of said resistance mass moves in an arc in a plane perpendicular to said hub's axis of rotation; and e. a crank engaged with said hub, said crank including a primary shaft parallel with said hub's axis of rotation, an offset arm projecting from said primary shaft, positionable at selected ancular offsets with respect to a line drawn from the axis of said hub to the centroid of said mass and means for actuating said crank.

2. The apparatus of claim 1, wherein said means for suspending said resistance mass comprises a suspension rod securely engaged with said hub and with said resistance mass.

3. The apparatus of claim 1, further including means for selectively positioning said resistance mass at a desired distance closer to or farther away from said hub.

4. The apparatus of claim 3, wherein said selective positioning means includes a suspension rod engaged with and radially projecting from said hub, said selective positioning means further including means for selectively securely engaging said hub with said suspension rod at any desired position along said suspension rod's length.

5. The apparatus of claim 3, wherein said selective positioning means includes a suspension rod engaged with and radially projecting from said hub, said selective positioning means further including means for selectively securely engaging said resistance mass with said suspension rod at any desired position along said suspension rod's length.

6. The apparatus of claim 1, wherein said means for actuating said crank includes means for securely engaging a portion of a user's body.

7. The apparatus of claim 6, wherein said body portion engaging means includes a handle shaft affixed to said offset arm, said handle shaft being arranged and dimensioned to permit a user to grasp said handle shaft securely with his or her hands.

8. The apparatus of claim 7, wherein said handle shaft is generally parallel to said crank's primary shaft.

9. The apparatus of claim 7, wherein said handle shaft is moveably attached to said offset arm for selective positioning of said handle shaft with respect to said offset arm.

10. The apparatus of claim 9, wherein said offset arm includes a plurality of telescopically engaged subunits able to be fixed securely in position with respect to one another such that after adjustment to a desired overall length, said subunits function as a single rigid unit.

* * * * *